US006549197B1

(12) United States Patent
Kim

(10) Patent No.: US 6,549,197 B1
(45) Date of Patent: Apr. 15, 2003

(54) TECHNIQUE FOR STABILIZING PICTURE OUTPUT IN VIDEO DISPLAY APPARATUS

(75) Inventor: Sung-Doug Kim, Suwon (KR)

(73) Assignee: Samsung Electronics Co., Ltd., Suwon (KR)

( * ) Notice: Subject to any disclaimer, the term of this patent is extended or adjusted under 35 U.S.C. 154(b) by 0 days.

(21) Appl. No.: 09/298,950

(22) Filed: Apr. 26, 1999

(30) Foreign Application Priority Data

Jun. 5, 1998 (KR) ..... 1998/20954

(51) Int. Cl.[7] ..... G09G 5/00

(52) U.S. Cl. ..... 345/211; 345/204; 345/213; 348/441

(58) Field of Search ..... 345/211, 213, 345/472, 603, 204, 698, 699; 348/552, 441, 644, 445

(56) References Cited

U.S. PATENT DOCUMENTS 5,241,281 A * 8/1993 Wilkes et al. ..... 345/14
5,594,467 A * 1/1997 Marlton et al. ..... 345/213
5,835,792 A * 11/1998 Wise et al. ..... 345/506
6,097,437 A * 8/2000 Hwang ..... 348/441
6,215,467 B1 * 4/2001 Suga et al. ..... 345/472

* cited by examiner

*Primary Examiner*—Richard Hjerpe
*Assistant Examiner*—Francis Nguyen
(74) *Attorney, Agent, or Firm*—Robert E. Bushnell, Esq.

(57) ABSTRACT

In accordance with a technique for stabilizing the picture output in a video display apparatus, the resolution of the video mode supplied from a PC, for example, is converted into a resolution of a pre-set video mode, thereby making it possible to output stabilized picture. The method for stabilizing a picture output in a video display apparatus includes the following steps. A power-on is recognized, and then a first power control signal is outputted. A counting is carried out for N seconds by an internal counter after outputting the first power control signal, and then a second power control signal is outputted. Then, counting is carried out for N/4 seconds by an internal counter after the outputting of the second power control signal, and control data and a clock signal are then outputted. In this manner, the format converter module and the circuit blocks are sequentially drive. Thus, the microcomputer drives the format converter module, and the format converter module converts externally input RGB signals to a resolution of a pre-set video mode so as to display stable full pictures.

20 Claims, 4 Drawing Sheets

TECHNIQUE FOR STABILIZING PICTURE OUTPUT IN VIDEO DISPLAY APPARATUS

CLAIM OF PRIORITY

This application makes reference to, incorporates the same herein, and claims all benefits accruing under 35 U.S.C. §119 from an application for APPARATUS FOR STABILIZING PICTURE OUTPUT IN VIDEO DISPLAY APPARATUS, AND STABILIZING METHOD THEREFOR earlier filed in the Korean Industrial Property Office on Jun. 5, 1998 and there duly assigned Ser. No. 20954/1998.

BACKGROUND OF THE INVENTION

1. Field of the Invention

The present invention relates to a technique for stabilizing the picture output in a video display apparatus. More specifically, the present invention relates to an apparatus and a method for stabilizing the picture output in a video display apparatus, in which the resolution of the video mode supplied from the PC is converted into a resolution of a pre-set video mode, thereby making it possible to output stabilized pictures.

2. Description of the Related Art

Generally, a video display apparatus has a microcomputer which functions as follows. That is, the video mode provided by a PC is judged by utilizing horizontal/vertical synchronizing signals which are supplied together with RGB signals from the PC. Further, in accordance with the judged video mode, horizontal/vertical synchronizing outputs of the RGB signals from the PC are controlled, thereby displaying normal pictures.

Further, the microcomputer checks as to the power-on-off status of the video apparatuses. If the checking shows that the power has been turned on, it is made sure that the power is supplied to the various circuit blocks of the video apparatus, so that normal pictures can be outputted based on the RGB signals.

The video display apparatus has a format converter module which communicates with the microcomputer and converts the resolution of the video mode (supplied from the PC) into a resolution of a pre-set video mode.

Under this condition, the communication method is a PC method. That is, the control data and the clock signals which are based on the video mode supplied from the microcomputer are transmitted to a microcomputer of the format converter module.

The format converter module converts the resolution of the video mode of the PC to a resolution of a pre-set VGA mode. Thus the RGB signals control the cathode ray tube, with the result that pictures are displayed on the screen of the video apparatus. That is, if the PC provides RGB signals based on a video mode such as VGA (640×480) or SVG (800×600) or XGA (1024×768), then the format converter converts the resolution of the RGB signals to a pre-set VGA mode.

That is, the format converter system converts the resolution of the final pictures of the video display apparatus to a resolution of a pre-set VGA mode, regardless of the resolution of the video mode which is selected by the PC.

Under this condition, the two sets of power control signals, the control data and the clock signals which are outputted from the microcomputer to the downstream blocks are simultaneously outputted without any time gap.

Therefore, it is not known which circuit begins to operate first among the circuit blocks (receiving the power control signals) and the format converter module (receiving the power control signals, the control data and the clock signals). In this unknown state, the resolution of the video mode from the PC is converted to a pre-set resolution.

That is, in a state with the digital system not stabilized, the format converter module operates in accordance with the control data of the microcomputer. As a result, not only system errors are liable to occur, but also a transition phenomenon occurs in the analog and digital systems. Consequently, the overall system becomes unstable, and unstable pictures are displayed.

SUMMARY OF THE INVENTION

The present invention is intended to overcome the disadvantages of the above-described technique.

Therefore, it is an object of the present invention to provide an apparatus and a method for stabilizing the video output in a video display apparatus, in which a microcomputer sequentially outputs signals, respective circuit blocks and a format converter of the video display apparatus are sequentially driven in accordance with the output signals of the microcomputer, and the resolution of the video mode of the PC is converted into a resolution of a pre-set video mode, so that RGB signals can control a cathode ray tube in a stable manner.

In achieving the above object, the apparatus for stabilizing a picture output in a video display apparatus according to the present invention includes: a microcomputer for sequentially outputting first power control signals, second power control signals, control data and clock signals with time gaps of certain magnitudes; a first power supply section driven by the first power control signal of the microcomputer for generating power to be supplied to respective blocks of the video display apparatus; a second power supply section driven by the second power control signal of the microcomputer for generating power to be supplied to a format converter module; and the format converter module being driven by power from the second power supply section to convert resolutions of RGB signals based on a pre-set video mode upon receipt of the control data from the microcomputer.

In another aspect of the present invention, the method of stabilizing a picture output in a video display apparatus according to the present invention includes the steps of: recognizing a power-on, and outputting a first power control signal; carrying out a counting for N seconds by an internal counter after outputting the first power control signal to output a second power control signal; and carrying out a counting for N/4 seconds by an internal counter after the outputting of the second power control signal to output a control data and a clock signal.

BRIEF DESCRIPTION OF THE DRAWINGS

A more complete appreciation of the invention, and many of the attendant advantages thereof, will be readily apparent as the same becomes better understood by reference to the following detailed description when considered in conjunction with the accompanying drawings in which like reference symbols indicate the same or similar components, wherein.

DETAILED DESCRIPTION OF THE PREFERRED EMBODIMENT

Figure 1:
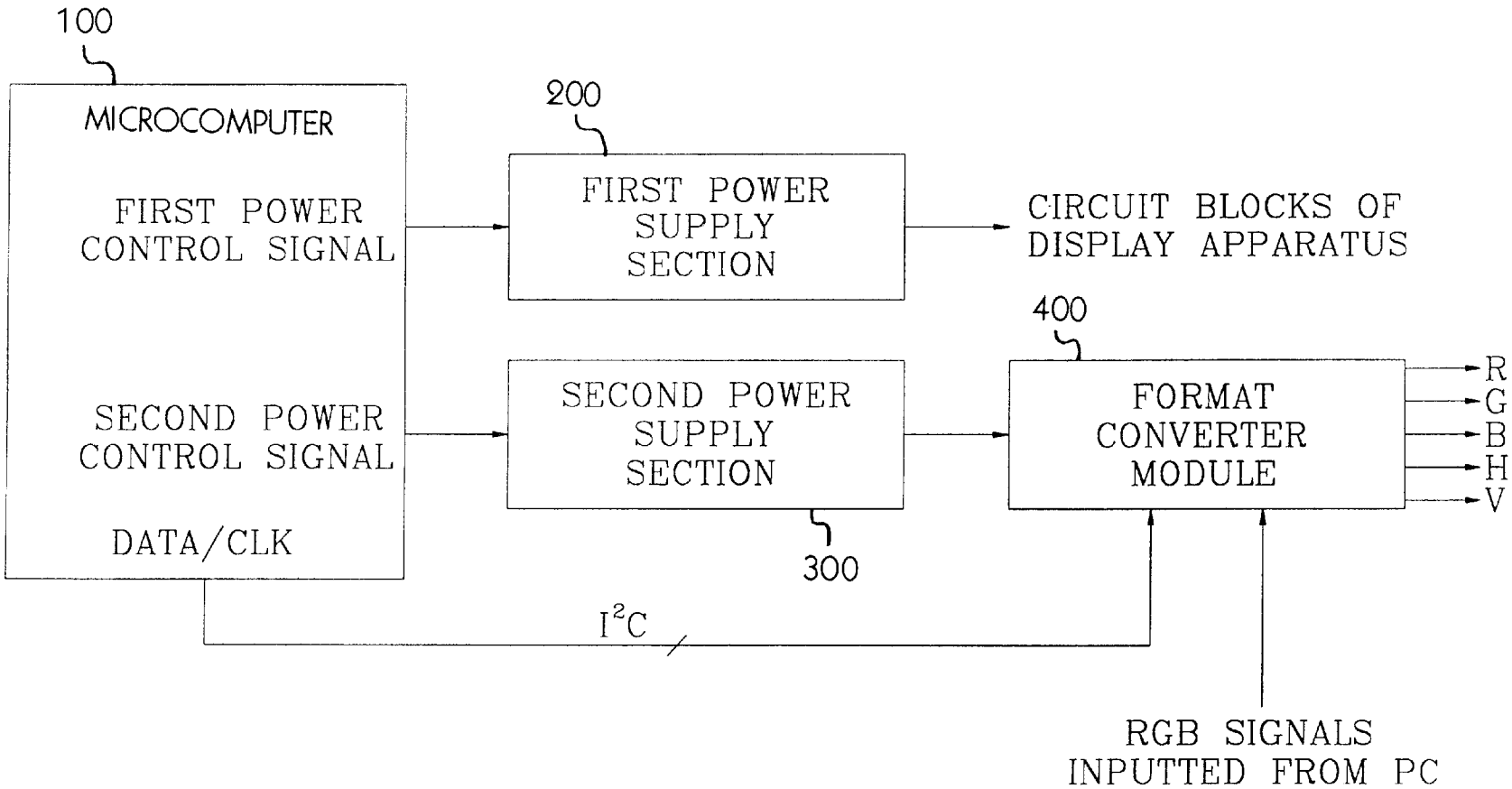
FIG. 1 is a block diagram showing the constitution of the apparatus for stabilizing the picture output in a video display apparatus according to the present invention.
Figure 2:
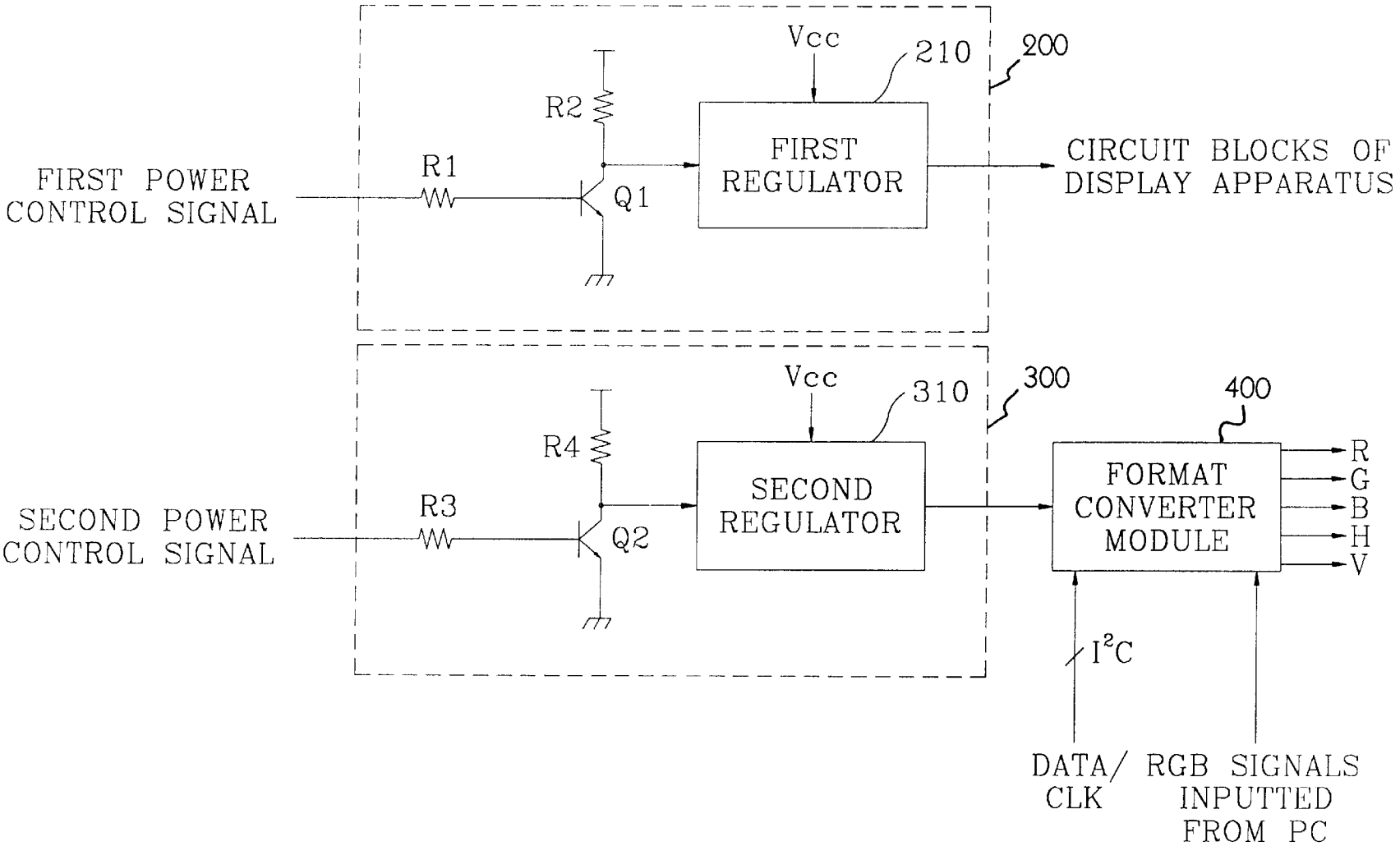
FIG. 2 is a circuit diagram applicable to the apparatus of FIG. 1.
Figure 3:
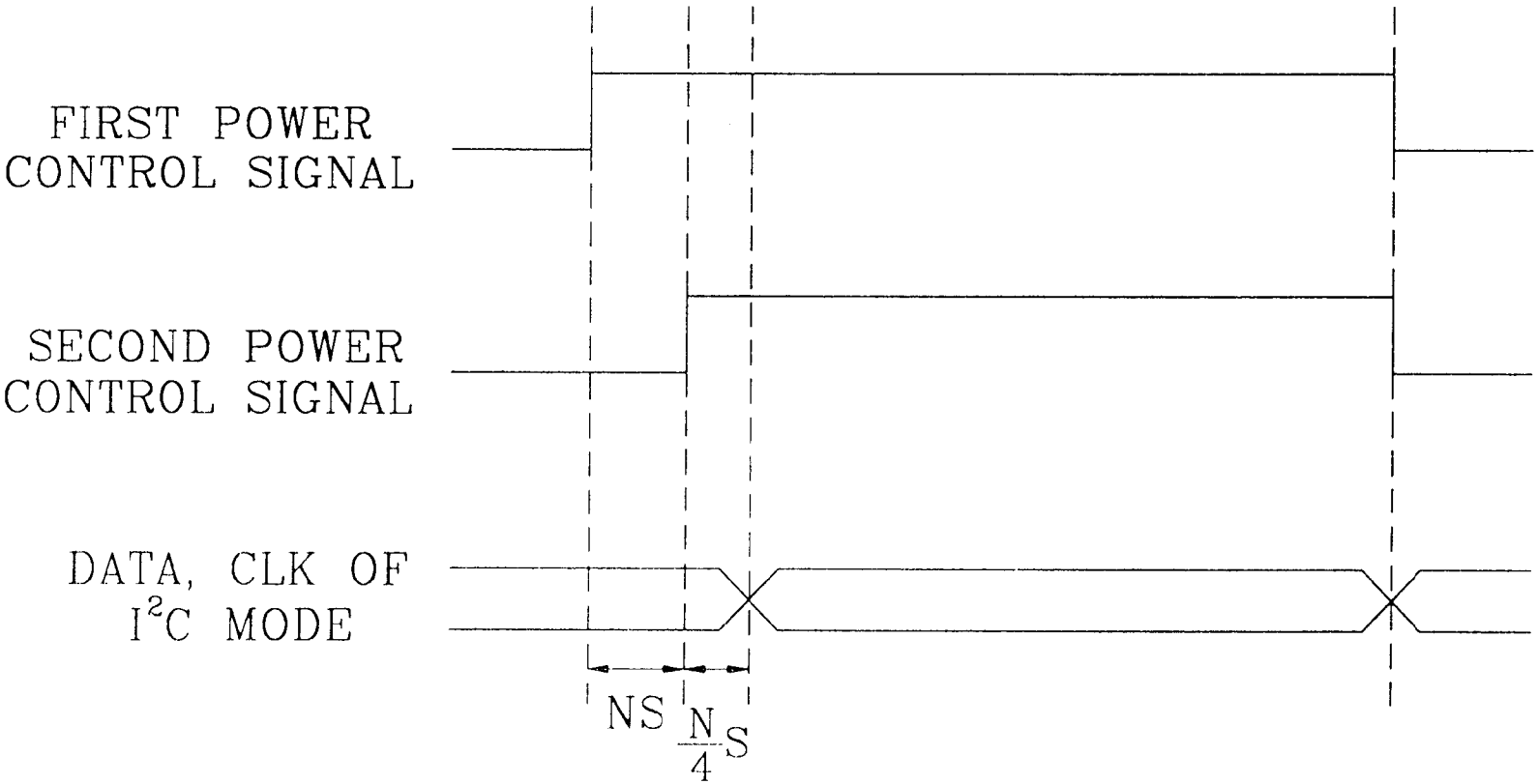
FIG. 3 illustrates the waveform patterns of the output signals of the microcomputer of FIG. 1.

FIG. 1 is a block diagram showing the constitution of the apparatus for stabilizing the picture output in a video display apparatus according to the present invention. FIG. 2 is a circuit diagram applicable to the apparatus of FIG. 1. FIG. 3 illustrates the waveform patterns of the output signals of the microcomputer of FIG. 1.

As shown in the drawings, the apparatus for stabilizing a picture output in a video display apparatus according to the present invention includes: a microcomputer 100 for sequentially outputting a first power control signal, a second power control signal, control data and a clock signal with time gaps of certain magnitudes; a first power supply section 200 driven by the first power control signal of the microcomputer 100 for generating power to be supplied to respective blocks of the video display apparatus; a second power supply section 300 driven by the second power control signal of the microcomputer 100 for generating power to be supplied to a format converter module 400; and the format converter module 400 being driven by power from the second power supply section 300 to convert resolutions of RGB signals based on a pre-set video mode upon receipt of the control data from the microcomputer 100.

The microcomputer 100 outputs a first power control signal, then outputs a second power control signal with an N-second delay, and then outputs control data and a clock signal with an N/4-second delay (refer to FIG. 3).

The first power supply section 200 includes: a first switching device Q1 driven by the first power control signal of the microcomputer 100; and a first regulator 210 for generating a constant level power in accordance with the operation of the first switching device Q1, and for supplying the constant level power to respective blocks of the video display apparatus.

The second power supply section 300 includes: a second switching device Q2 driven by the second power control signal of the microcomputer 100; and a second regulator 310 for generating a constant level power in accordance with the operation of the second switching device Q2, and for supplying the constant level power to the format converter module 400 of the video display apparatus.

The first and second switching devices consists of NPN transistors. Reference designations R1–R4 in the drawings indicate resistors.

Now the method for stabilizing the picture output in a video display apparatus according to the present invention will be described.

Figure 4:
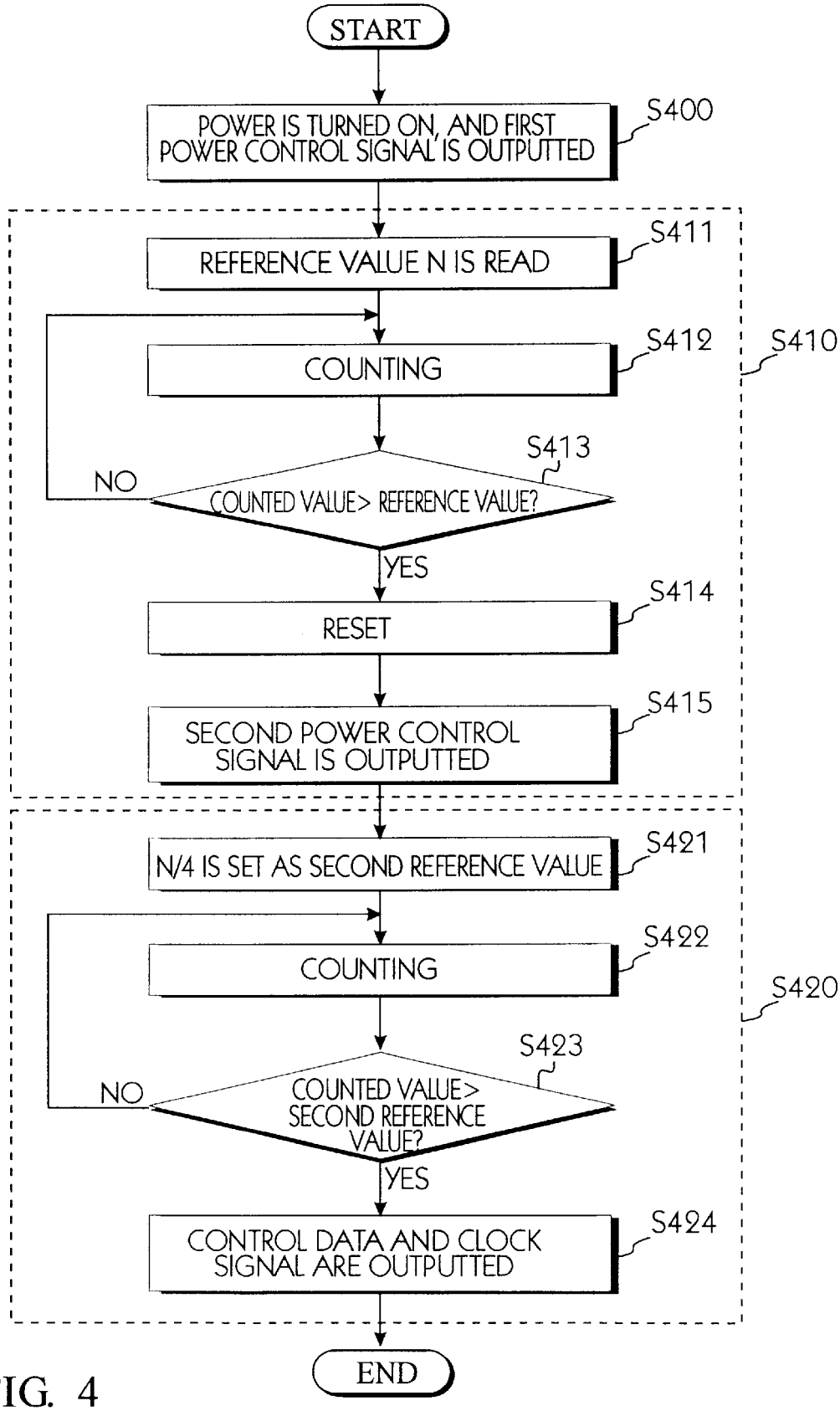
FIG. 4 is a flowchart showing the method of stabilizing the picture output in a video display apparatus according to the present invention.

FIG. 4 is a flowchart showing the method for stabilizing the picture output in a video display apparatus according to the present invention.

As shown in this drawing, the microcomputer 100 checks as to whether the PC and the video display apparatus are turned on or off. If the power is turned on, then a first power control signal is outputted (S400).

After outputting the first power control signal at the step S400, the microcomputer 100 outputs a second power control signal with a certain time delay (S410).

After the step S400, a reference value N is read from an internal memory (S411), and then, an internal counter (not shown in the drawings) begins to count (S412).

A determination as to whether the counting exceeds the reference value N is made (S413), and if the reference value is exceeded, the counter is reset (S414), and then a second power control signal is outputted (S415). If the reference value N is not exceeded, the counting step (S412) is repeated.

As described above, after outputting the second power control signal, the microcomputer 100 outputs control data and a clock signal with a time delay again (S420).

Step S420 will be described in further detail. After outputting the second power control signal at step S415, the pre-set reference value N is read. Then, a value corresponding to ¼ of the value N is calculated to set a second reference value (S421). A counter (not shown) begins to count (S422), and then, a determination as to whether the counting exceeds the second reference value is made (S423). If the counting exceeds the second reference value, then control data and a clock signal are outputted (S424). If the counting does not exceed the second reference value, the counting step (S422) is repeated.

For example, if the first reference value is 2s, the second reference value is 500 ms. Therefore, the microcomputer 100 outputs first a first power control signal, then outputs a second power control signal with a 2s time delay, and then outputs control data and a clock signal with a 500 ms time delay.

That is, if the PC and the video display apparatus are turned on, the microcomputer 100 of the video display apparatus supplies power from the first power supply section 200 to respective circuit blocks of the video display apparatus to drive the circuit blocks.

Then, power is supplied from the second power supply section 300 to the format converter module, and then control data and a clock signal are transmitted to the format converter module so that the RGB signals from the PC can be converted to a resolution of a pre-set video mode.

According to the present invention as described above, the microcomputer exercises control in such a manner that the main power is supplied to the video display apparatus, and then the power is supplied to the format converter module. Then, control data of an $I^2C$ mode is outputted to control the operation of the format converter module. Therefore, stable full pictures can always be displayed regardless of the RGB signals based on different video modes.

It should be understood that the present invention is not limited to the particular embodiment disclosed herein as the best mode contemplated for carrying out the present invention, but rather that the present invention is not limited to the specific embodiments described in this specification except as defined in the appended claims.

What is claimed is:

1. An apparatus for stabilizing a picture output in a video display apparatus, comprising:

a microcomputer for sequentially outputting a first power control signal, a second power control signal, control data and a clock signal;

a first power supply section driven by the first power control signal of said microcomputer for generating power supplied to respective blocks of said video display apparatus; and a second power supply section driven by the second power control signal of said microcomputer for generating power supplied to a format converter module;

said format converter module being driven by said second power supply section to convert resolutions of RGB signals based on a pre-set video mode upon receipt of the control data from said microcomputer, said microcomputer driving said format converter module, and said converter module converting externally generated RGB signals to a resolution of the pre-set video mode so as to cause the video display apparatus to display stable full pictures.

2. The apparatus as claimed in claim 1, said microcomputer outputting said first power control signal, then outputting said second power control signal with an N-second delay, N being a positive number, and then outputting said control data and said clock signal with an N/4-second delay.

3. The apparatus as claimed in claim 1, said first power supply section comprising:

a switching device driven by said first power control signal of said microcomputer; and a regulator for generating constant level power in accordance with operations of said switching device, and for supplying the constant level power to respective blocks of said video display apparatus.

4. The apparatus as claimed in claim 1, said second power supply section comprising:

a switching device driven by said second power control signal of said microcomputer; and a regulator for generating constant level power in accordance with operations of said switching device, and for supplying the constant level power to said format converter module of said video display apparatus.

5. The apparatus as claimed in claim 3, said switching device comprising a transistor.

6. The apparatus as claimed in claim 5, said transistor comprising an NPN transistor.

7. The apparatus as claimed in claim 4, said switching device comprising a transistor.

8. The apparatus as claimed in claim 7, said transistor comprising an NPN transistor.

9. A method of stabilizing a picture output in a video display apparatus, comprising the steps of:

recognizing a power-on, and outputting a first power control signal;

counting for N seconds, N being a positive number, after outputting the first power control signal, and then outputting a second power control signal; and counting for N/4 seconds after outputting the second power control signal, and then outputting control data and a clock signal.

10. The method as claimed in claim 9, wherein the step of counting for N seconds comprises the substeps of:

reading a pre-set reference value N;

counting by an internal counter;

determining whether a count counted by the internal counter exceeds the pre-set reference value N; and resetting the internal counter and outputting the second power control signal when the count exceeds the pre-set reference value N, and again counting when the count does not exceed the pre-set reference value.

11. The method as claimed in claim 9, wherein the step of counting for N/4 seconds comprises the substeps of:

reading a reference value N;

setting a second reference value by calculating a value corresponding to ¼ of N; and outputting the control data and the clock signal when the counting exceeds the second reference value.

12. An apparatus for stabilizing a picture output in a video display apparatus, comprising:

microcomputer means for sequentially outputting a first power control signal, a second power control signal, control data and a clock signal;

first power supply means driven by the first power control signal from said microcomputer means for generating power supplied to respective blocks of said video display apparatus;

second power supply means driven by the second power control signal from said microcomputer means for generating power; and format converter means driven by the power from said second power supply means for converting resolutions of RGB signals based on a pre-set video mode in response to the control data from said microcomputer means, and for converting externally generated RGB signals to a resolution of the pre-set video mode so as to cause the video display apparatus to display stable full pictures.

13. The apparatus as claimed in claim 12, said microcomputer means outputting said first power control signal, outputting said second power control signal with an N-second delay, N being a positive number, and then outputting the control data and the clock signal with an N/4-second delay.

14. The apparatus as claimed in claim 12, said first power supply means comprising:

a switching device driven by said first power control signal of said microcomputer means; and a regulator for generating constant level power in accordance with operations of said first switching device, and for supplying the constant level power to respective blocks of said video display apparatus.

15. The apparatus as claimed in claim 14, said second power supply means comprising:

an additional switching device driven by said second power control signal of said microcomputer means; and an additional regulator for generating additional constant level power in accordance with operations of said additional switching device, and for supplying the additional constant level power to said format converter means.

16. The apparatus as claimed in claim 15, said additional switching device comprising a transistor.

17. The apparatus as claimed in claim 16, said transistor comprising an NPN transistor.

18. The apparatus as claimed in claim 14, said switching device comprising a transistor.

19. The apparatus as claimed in claim 18, said transistor comprising an NPN transistor.

20. The apparatus as claimed in claim 12, said second power supply means comprising:

a switching device driven by said second power control signal of said microcomputer means; and a regulator for generating constant level power in accordance with operations of said switching device, and for supplying the constant level power to said format converter means.

* * * * *